United States Patent [19]

Rouleau

[11] Patent Number: 4,520,984

[45] Date of Patent: Jun. 4, 1985

[54] HANGING BRACKET FOR SUSPENDING OVERHEAD SIGNS

[76] Inventor: Robert J. Rouleau, 28 Cedar Knoll Rd., Cockeysville, Md. 21030

[21] Appl. No.: 491,706

[22] Filed: May 5, 1983

[51] Int. Cl.[3] ..... G09F 7/22

[52] U.S. Cl. ..... 248/489; 248/317; 248/900

[58] Field of Search ..... 248/466, 475 B, 447, 248/61, 900, 278, 279, 317, 489; 403/158

[56] References Cited

U.S. PATENT DOCUMENTS

| | | | |
|---|---|---|---|
| 2,889,128 | 6/1959 | Martin et al. | 248/324 |
| 2,956,768 | 10/1960 | Livingston . | |
| 3,152,846 | 10/1964 | Dumpis | 403/158 |
| 3,891,175 | 6/1975 | Hanley et al. | 248/317 |
| 4,089,129 | 5/1978 | Patterson | 40/606 |
| 4,413,803 | 11/1983 | Ross | 248/475 B |

FOREIGN PATENT DOCUMENTS

| | | | |
|---|---|---|---|
| 2455205 | 12/1980 | France | 403/158 |

*Primary Examiner*—Reinaldo P. Machado
*Assistant Examiner*—Alvin Chin-Shue
*Attorney, Agent, or Firm*—John F. McClellan, Sr.

[57] ABSTRACT

An improved adjustable overhead sign bracket system of the type having: a supporting cable clamp, adjustment in the plane of a supporting cable for setting lateral angle of a sign, adjustment about a substantially vertical axis for setting direction in which a sign is to face, and provision permitting a sign to swing in the plane of the direction in which facing to lessen the magnitude of wind loads, provides improved access and swinging clearance at the adjustment about a substantially vertical axis, in the form of a centrally located vertical locking bolt as slim shank portion of an integral inverted "T" member, the lower, substantially horizontal portion of which is a compact sleeve for a pivot bolt providing for the swinging of a sign suspended from it by a sign frame having upward arms engaging the pivot bolt; for economy and versatility in wrenching operations and adjustment in fabrication if desired, the vertical locking bolt may be a conventional bolt with head welded to the sleeve, and a nut and backing plate welded in a place on the threaded end permitting capture and tightening by a nut on the threads of the elements providing the vertical-axis adjustment; a force-fitted protrusion-end "Nylon" bushing in the sleeve coacts with the upward arms and pivot bolt fixed in them to minimize wear.

1 Claim, 4 Drawing Figures

HANGING BRACKET FOR SUSPENDING OVERHEAD SIGNS

FIELD OF THE INVENTION

This invention relates generally to supports, and particularly to an improved hanging bracket for suspending overhead signs.

BACKGROUND OF THE INVENTION

The need for supporting large and heavy signs overhead is at least as old as internal combustion vehicles, and increases with volume and speed of traffic to be directed.

The purpose of such devices is to maintain stability and proper positioning of signs or other objects that have to be accurately positioned in suspension over roadways. This type hanging bracket allows for free swinging movement parallel with roadway to keep legends visible to motorists or pedestrians and must return signs to original position at the conclusion of each gust of wind, with precision, and at all times must hold signs within limits preventing damage to traffic signals, cables carrying electricity and span cables.

Many types of sign supports have been disclosed for overhead use, but the problem of providing a reliable, positively adjustable bracket system for the purpose has remained. Weather effects have tended to wear out the best apparatus prematurely, prior to this invention, which is intended to provide an indefinite life for such suspensions.

A well known type of bracket system illustrating the necessary geometric adjustment and attachment provisions is described in U.S. Pat. No. 2,956,768 issued to S. D. Livingston on 10-18-60. These include, in sequence downward to a sign hung at the bottom: means for attachment to a supporting cable, means for lateral adjustment in a plane defined by the supporting cable, means for adjustment about a vertical axis to set the direction in which a sign is to face, means permitting swinging in the plane in which the sign is to face, and means for attachment of the sign to the bracket.

In U.S. patents of general interest:

No. 2,889,128 to A. S. Martin and J. E. McCleary, 6-2-59, disclosed an "L"-shaped body member in a sign-supporting bracket;

No. 3,891,175 to W. L. Hawley and T. E. Lewis, 6-24-75, disclosed a traffic signal hanger with vertical-axis adjustment;

No. 4,089,129 to W. W. Patterson, Jr., 5-16-78, disclosed a sign hanger with strap-type hinges.

SUMMARY OF THE INVENTION

Principal objects of this invention in addition to greatly increasing service life, are to provide an improved system of the type described, which simplifies and refines the mechanism while making adjustment easy and convenient with common wrenches, and more positive, and increasing scope of permitted sign swing.

Further objects are to provide a system as described which is made to be safer, and to be more economical regardless of initial cost, than the prior art, by reducing wind-turning, wear, corrosion and swinging impact damage, so that failures, and repair and replacement needs are minimized or eliminated altogether.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
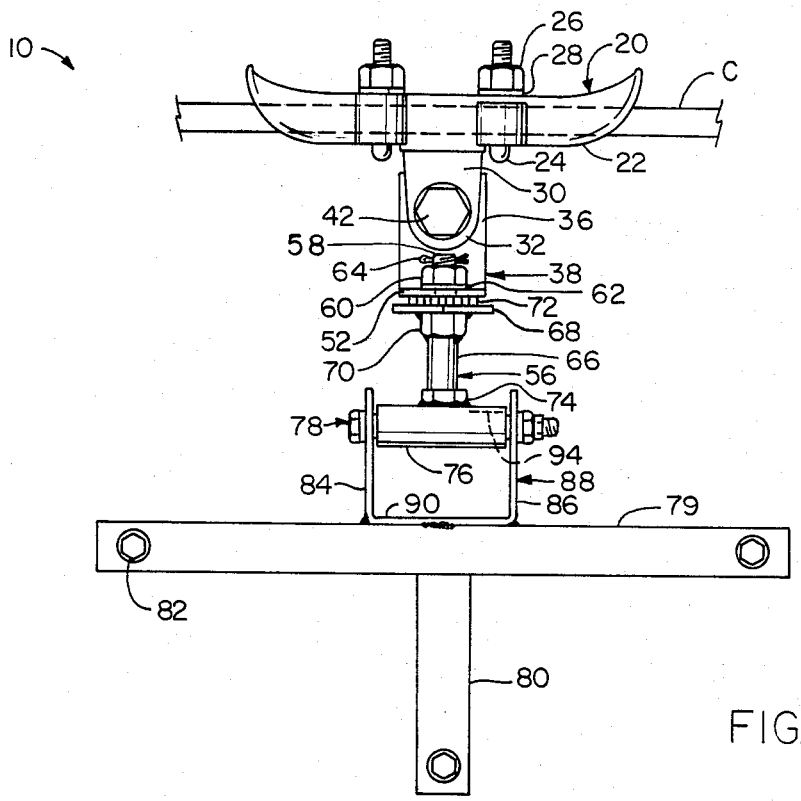
FIG. 1 is a front elevational view of the invention suspended from a cable.
Figure 2:
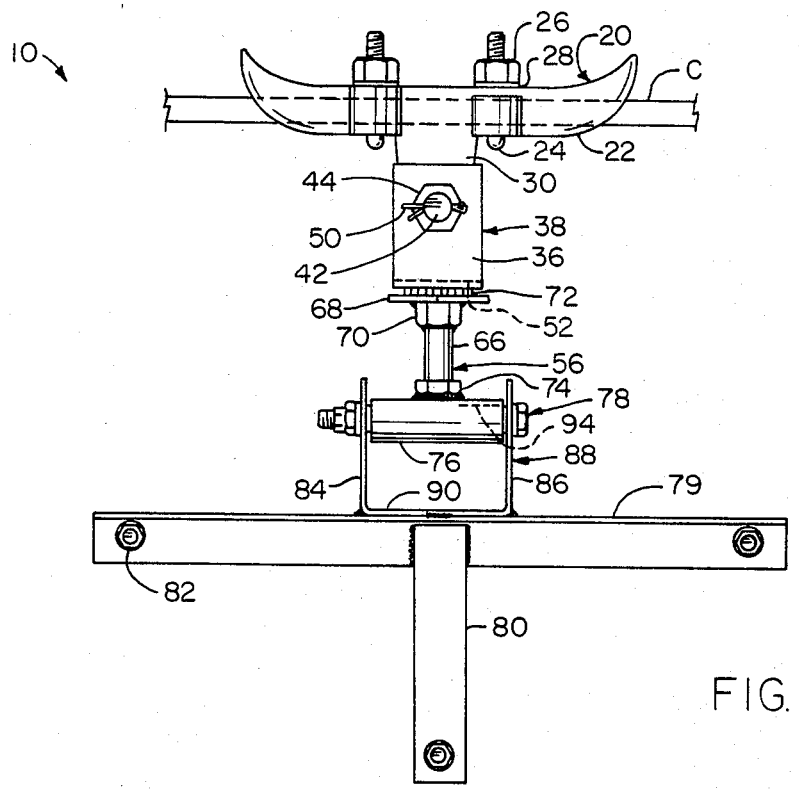
FIG. 2 is a rear elevational view thereof.
Figure 3:
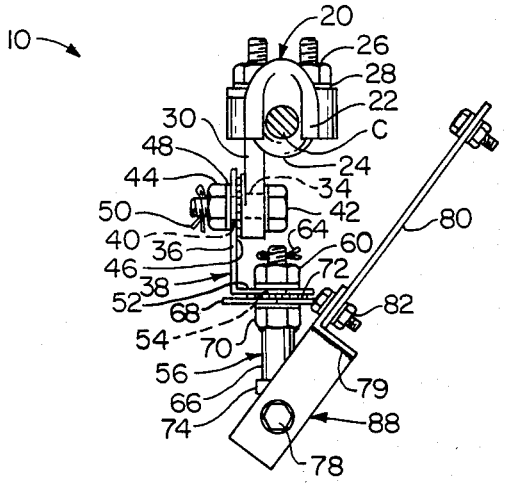
FIG. 3 is a side elevational view in an extreme position of articulation.

FIGS. 1, 2 and 3 show in assembly a preferred embodiment 10 of the invention.

Generally known parts of the combination are described first.

Means for attachment to a supporting cable C comprises an integral saddle clamp 20 in the form of an inverted "U"-channel portion 22 secured by a pair of "J" bolts 24 grasping the cable from opposite sides below and passing up through the inverted "U"-channel portion to securance at the top by nuts 26 with lock washers 28.

Means for setting lateral angle in a plane defined by the supporting cable includes a flange 30 that extends centrally downward from one arm of the inverted "U"-channel portion and terminates in a rounded end 32, centered on a transverse hole 34 (FIG. 3) through the flange 30, and the upright arm 36 of a right-angle piece 38 with a hole 40 (FIG. 3) through it near the top, by which a bolt 42 and nut 44 draw members 30 and 36 together against an external tooth lock washer 46 (FIG. 3) between them. A conventional split lock washer 48 (FIG. 3) is secured under the nut, and a nut-retaining cotter key 50 is provided through a suitable hole in the free end of the bolt.

Means for adjustment about a vertical axis to fix the direction in which a suspended sign is to face, includes the horizontal arm 52 of right angle piece 38, which has a central hole 54 (FIG. 1 and FIG. 3) through it, but the remainder of this provision, and the next provision, are novel although functioning in analogous manner to known art.

Co-acting with the horizontal arm 52 and hole 54 in the known art as represented by a prior invention of the present inventor, was a length of square tubing horizontally arranged and held to the horizontal arm 52 by engagement of a nut-held bolt passed through the upper wall of the square tubing. An external tooth washer on the bolt was sandwiched between the upper wall of the square tubing and the underside of the horizontal leg so that it would freeze the two in selected rotational relation when the bolt was tightened.

Welded centrally along the top of the lower wall of the square tubing parallel with the axis of the square tubing was a length of cylindrical tubing with a long axle-bolt secured by a nut in rotatable fit therethrough. Loosely but securely held by passage of the bolt through the perforations, at each end of the cylindrical tubing was a respective perforate leg of a square "U"-shaped member like the similar member described below, and like the similar member welded along the base of the square "U"-shaped member to a central part of a sign-engaging portion.

Unfortunately, protrusion of the square-shaped tubing prevented full swing of a sign about the axis of the pivot bolt or axle-bolt. Unfortunately, also, there was no conveniently accessible gripping place provided for a second wrench to hold the vertical bolt while the nut on it was tightened.

The vertical bolt of U.S. Pat. No. 2,956,768 (shown at 28, FIG. 1 of the patent) was even less accessible, the nut being in tunnel-like confinement, requiring a limited stroke in tightening, and the bolt head was inaccessible for wrenching in the opposite direction in tightening. A special splined-fit dictated need for loosening and tightening the nut for each minute change in direction a sign was to be set facing.

The present invention avoids these problems by provision of a unitary inverted "T"-shaped member 56 which provides for superior wrenching access, and for greater sign swing (FIG. 3) for yielding to gusts of wind in the direction in which facing. The sign can swing to even a more acute angle than shown in FIG. 3 because the head of bolt 82 does not strike any other structure, being outboard in location in face view. Thinness of sign bracket in edge view and span of the legs also provide necessary clearance for the high swing.

At the upper end the inverted "T"-shaped member 56 has a perforate threaded portion 58 for securance through hole 54 by nut 60 and lockwasher 62 and cotter key 64 on the upper side of the horizontal arm 52. For economy in manufacture the threaded portion may be the threaded part of a bolt 66 or vertical locking bolt, with a backup plate 68 held at a hex nut 70. Both nut and backup plate may be welded to the bolt in position below the horizontal leg, giving good clearance, broad support, and a secure grip or structure for counter-wrenching to tighten the nut 60, and draw the horizontal arm 52 and backup plate 68 together against a locking means or external tooth lock washer 72, which fixes the rotational relation between the two.

The faceted head 74 of the vertical locking bolt 66 is welded perpendicularly at the center of the length of the cross part of the "T"-shape, the cylindrical tubing 76. This provides a further convenience in addition to broad-area welding. The jaw-end of the wrench used for countering the torque of tightening the nut 60 may be rested on the cylindrical tubing 76 while grasping the nut, just as the nut-engaging wrench may be braced on the horizontal arm 52, considerably easing the problem of simultaneous operation of two wrenches.

Details of the bushing and pivot bolt or axle bolt 78 are given below, but the simplified sign hanger comprising a horizontal leg 79 of suitable length, preferably of angle material, and a flat vertical leg 80 welded to and depending from the center of the horizontal leg, and bolts 82 in both, provide for secure sign hanging.

Figure 4:
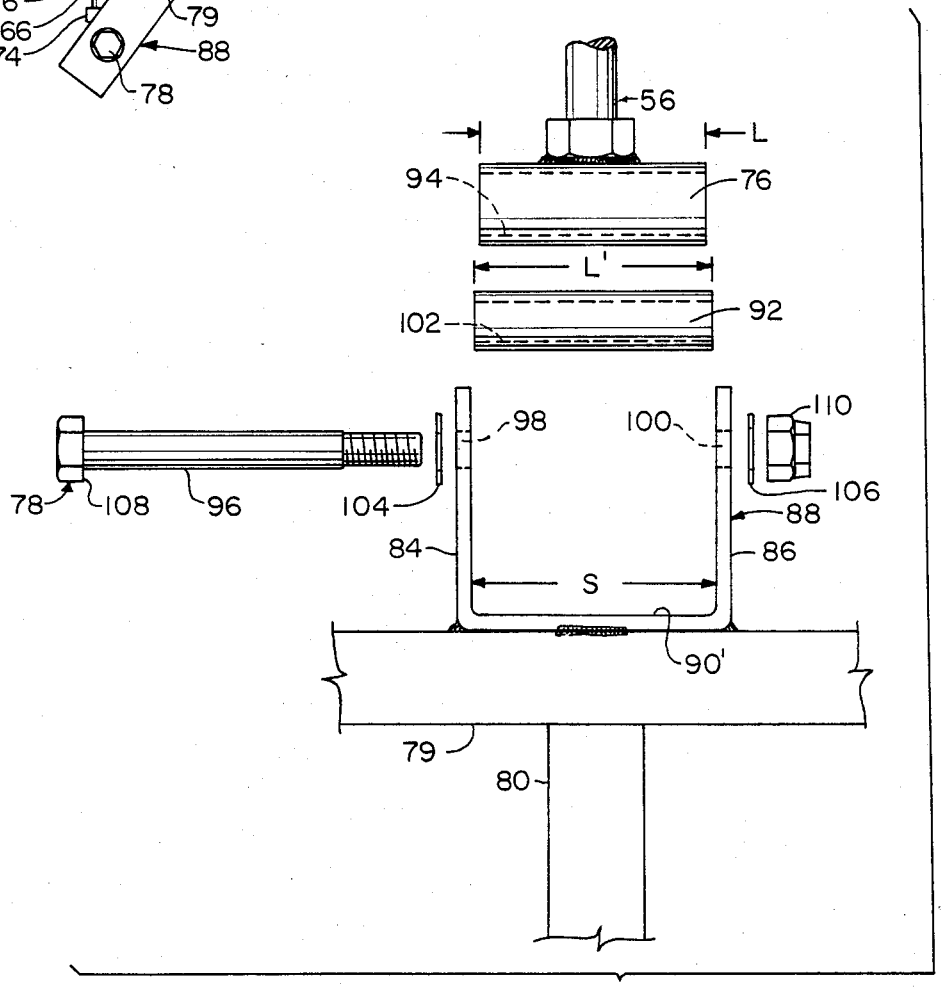
FIG. 4 is an elevational exploded fragmentary detail view.

FIG. 4 which is now referred to in conjunction with the first three Figures, shows in exploded view the greatly improved provisions for the working joint of the invention. This joint is of the type that responds to nearly every gust of wind by permitting a sign held by the legs (79 and 80) to swing in response and "spill" the wind rather than torsionally loading the cable attachment and otherwise stressing the assembly.

The problem in the known art with analogous working joints of the type is that they tend to wear out, being subject to the weather and not being accessible for frequent lubrication and inspection and adjustment. In known art, the pivot bolt or axle bolt tends to wear and to come loose, and the cylindrical member tends to wear.

All these problems are simply avoided by the present invention

Spacing S between arms 84 and 86 of the square "U"-shaped element 88, the base 90 of which is welded to the leg 79, is made greater than the length L of the cylindrical tubular portion 76 but equal to the length L' of the cylindrical "Nylon" bushing 92. The unitary "Nylon" bushing 92 is force fitted into the bore 94 of the cylindrical tubular portion 76 with an equal length protruding by about 1/16 inch (1.5 mm) at each end and bearing on the inside surface of a respective leg.

Proportions of the pivot bolt or axle-bolt 78 make a press fit of the body 96 of the bolt in each of the coaxial mounting holes 98, 100 in the legs but make a free swinging fit with the bore 102 of the "Nylon" bushing 92. On assembly, with a respective loose-fitting plain washer 104, 106 shielding the bolt head 108 and the self-locking nut 110, working of the joint is cushioned by the bushing and wear (and noise) are nearly eliminated.

MATERIALS AND DIMENSIONS

Metal parts of the invention preferably of stainless steel. The axle bolt or pivot bolt may be a 4 inch (10 cm) by ½ inch (13 mm) bolt riding in a 3 inch (7.5 cm) long "Nylon" (or other suitable thermoplastic) bushing. The cylindrical tubular portion 76 may be 1 inch (2.5 cm) O.D. and with a 1/16 inch (1.5 mm) wall, and may be 3 inches (7.5 cm) long.

The vertical locking bolt 66 may be 2 inches (5 cm) long by ⅝ inch (3 cm) diameter.

Length of the upright arm 36 should be such as to provide clearance between bolt 42 in it and the end of the vertical locking bolt 66 in the horizontal arm.

Distance between packing plate 68 and the cylindrical portion 76 may be 2$\theta$ inches (5.6 cm) and between the center of the pivot bolt or axle-bolt 78 and the top of the horizontal leg 79 may be the same.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States letters patent is:

1. In a system for suspending overhead signs and having: cable clamping means, means for setting lateral angle of a sign in the plane of a cable, means for fixing facing-direction of a sign about a substantially vertical axis including a horizontal arm attached below the means for setting; means permitting swinging of a sign in the plane of the facing direction, including a sleeve, a pivot bolt in the sleeve and arm structure connected with the pivot bolt and sleeve, the improvement comprising: the means for fixing facing-direction including an inverterd "T"-shaped member including a shank in the form of a vertical locking bolt having a threaded upper end proportioned for receiving thereon: said horizontal arm, a backing member, a nut for securing together said horizontal arm and backing member; said shank having thereon a structure for wrenching, said sleeve being affixed transversely on the lower end of said vertical locking bolt, means for minimizing wear of said means permitting swinging including a unitary thermoplastic bushing, said thermoplastic bushing secured within the bore of said sleeve and having a portion protruding from each end thereof in position for bearing on said arm structure, locking means between said horizontal arm and backing member, said locking means being an external-tooth lock washer, said structure for wrenching comprising a nut welded on a part of the threaded upper end below said backing member, said backing member being a backing plate welded to said nut welded on said part of the threaded upper end, and said structure for wrenching further comprising said vertical locking bolt having at said lower end a faceted head.

* * * * *